United States Patent [19]

Pautsch et al.

[11] 4,113,172

[45] Sep. 12, 1978

[54] CENTRIFUGE WHOSE DRUM CASING IS CONTINUOUSLY COOLED BY A COOLANT CIRCULATED WITHIN AN INSERT DISPOSED IN THE SOLIDS CHAMBER

[75] Inventors: Gunthard Pautsch; Werner Kohlstette, both of Oelde, Germany

[73] Assignee: Westfalia Separator Aktiengesellschaft, Oelde, Germany

[21] Appl. No.: 811,421

[22] Filed: Jun. 29, 1977

[30] Foreign Application Priority Data

Jul. 10, 1976 [DE] Fed. Rep. of Germany ..... 2631110

[51] Int. Cl.[2] ..... B04B 15/02

[52] U.S. Cl. ..... 233/11; 233/20 A

[58] Field of Search ..... 233/11, 20 R, 20 A, 233/1 R, 1 E, 46, 47 R

[56] References Cited

U.S. PATENT DOCUMENTS

| | | | |
|---|---|---|---|
| 1,897,613 | 2/1933 | Jensen | 233/11 |
| 3,981,437 | 9/1976 | Hemfort et al. | 233/11 |
| 4,052,304 | 10/1977 | Vertenstein | 233/11 |

*Primary Examiner*—George H. Krizmanich

*Attorney, Agent, or Firm*—Burgess, Dinklage & Sprung

[57] ABSTRACT

Centrifuge (FIG. 1) having an insert composed of lower portion 9*a* and upper portion 9*b*. The insert portions have helical passageways, respectively, 24, 26, for circulation of a heat exchange fluid for temperature control of the separated solids in solids chamber 8. A rib 31 joins the insert portions and has a passageway 25 for transfer of the fluid from the helical passage of the lower portion 9*a* to the helical passageway of the upper portion 9*b*, and a passageway 27 for discharge of the fluid.

6 Claims, 2 Drawing Figures

Figure 1:
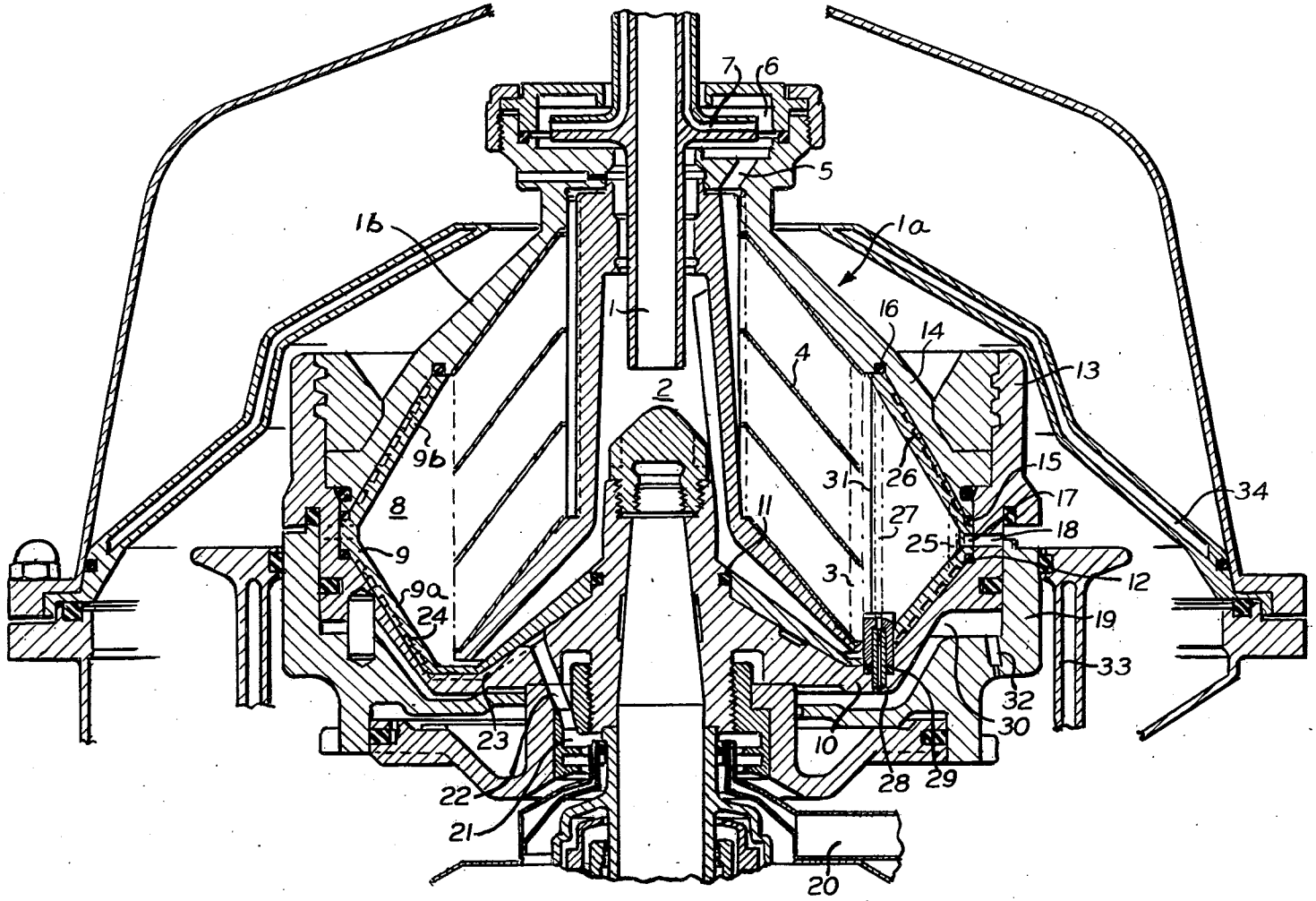

CENTRIFUGE WHOSE DRUM CASING IS CONTINUOUSLY COOLED BY A COOLANT CIRCULATED WITHIN AN INSERT DISPOSED IN THE SOLIDS CHAMBER

BACKGROUND

The invention relates to a centrifuge having a spin drum whose casing can be continuously cooled by means of an insert disposed in the solids chamber and carrying a circulating coolant, the insert being supported at a plurality of points on the drum casing and being sealed off from the separating chamber of the drum.

Such a centrifuge is known, for example, from German Auslegeschrift No. 24 23 319, in which the liquid which is to be clairifed or separated is cooled in the centrifuge by a first circulated coolant and is held at a low spinning temperature, the coolant leaving the drum casing at a point located radially outwardly and being thrown against a jacket which is affixed to the frame, surrounds the drum, and is cooled by a second coolant.

While the separated or clarified liquid is continuously carried out of the centrifuge drum, the removed solids remain in the solids chamber of the cylindrical, solid-walled drum and have to be removed manually from the drum at certain intervals of time. The manual removal of the solids from the solids chamber of a centrifuge drum, however, always involves a great amount of time and labor, and can be accepted economically only if the cleaning, i.e., the removal of the solids from the drum, can be performed at relatively great intervals of time, i.e., where only small amounts of solid particles are separated.

In practice, however, there are numerous liquids containing solids, which have to be centrifuged in the cooled state, and which contain a very large content of solids; a centrifuge of the known kind is disadvantageous, since it has to be shut down at brief intervals of time, and taken apart, and the solid matter has to be removed manually. The frequent shutting down of the spinning drum furthermore very greatly reduces the efficiency of the cooling system.

THE INVENTION

The object of the invention consists in creating a coolable centrifuge drum in which the solids can be removed continuously, i.e., without disassembling the drum.

This object is achieved by the fact that the coolable insert is of conical construction and has one or more sludge removal apertures along its circumference, and the outsides of the lower insert portion and of the upper insert portion are provided with helically disposed passages which are connected together by means of connecting passages disposed in the rib joining the lower and the upper insert portions.

In the design of the coolable insert in accordance with the invention, the sludge removal apertures are preferably opened and closed by an axially movable piston slide valve, so that, depending on the solids contents, the solids collected in the solids chamber can be removed by full or partial discharges.

In another design, the sludge removal apertures are in communication with permanently open discharge nozzles disposed along the circumference of the drum periphery.

In the drawing there are shown two examples of the embodiment of the invention with different methods of removing the solids from the coolable spin drum.

Figure 2:
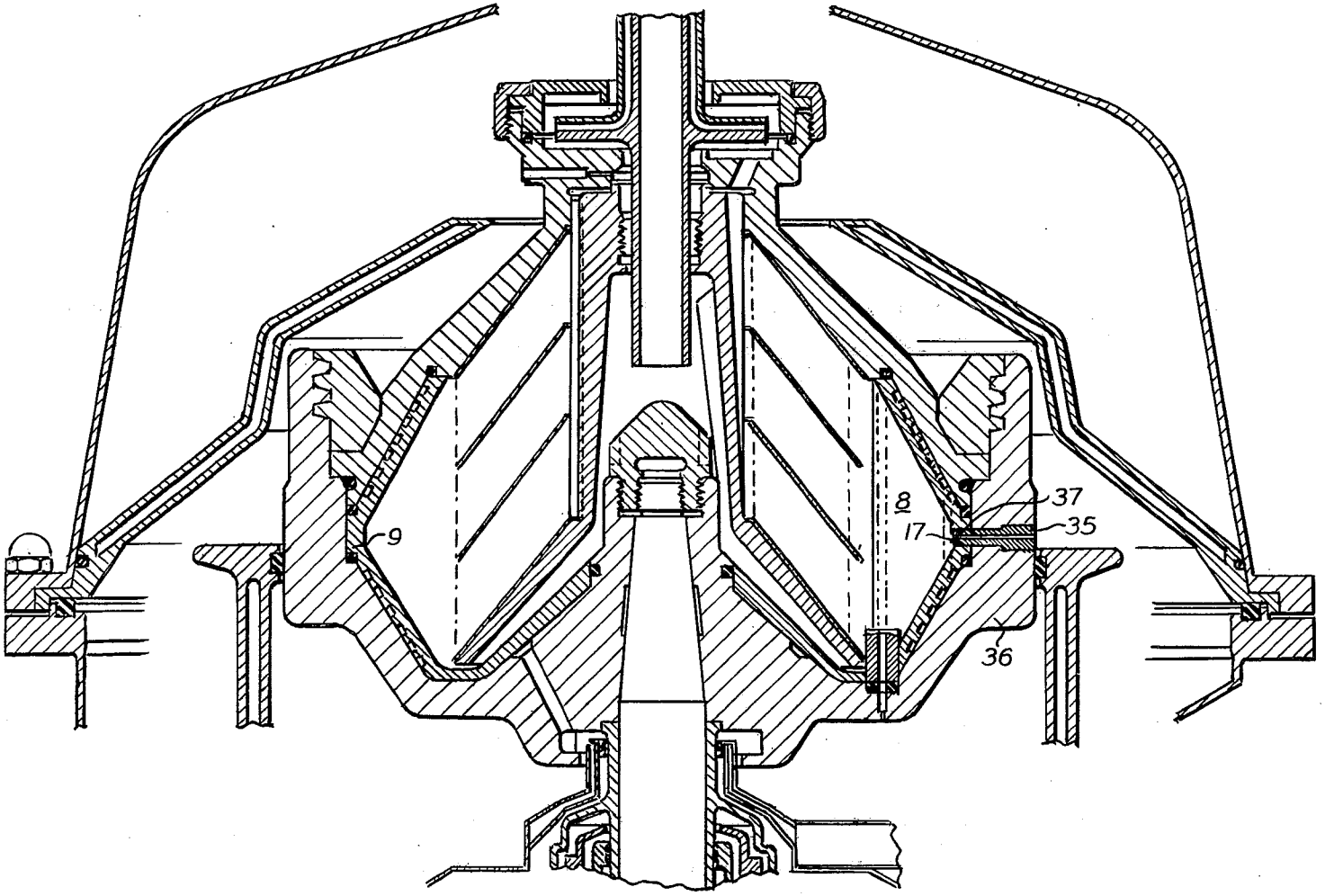

FIG. 1 shows a cross sectional view of a spin drum in which the sludge removal apertures of the coolable insert are opened and closed by an axially movable piston slide valve, and FIG. 2 is a cross sectional view taken through a spin drum in which the sludge removal apertures of the coolable insert are in communication with permanently open discharge nozzles.

In FIG. 1, the centrifuge comprises a rotatable drum 1*a* having outer casing 1*b*. The liquid mixture to be clarified of solids is carried centrally through the inlet tube 1 into the distributor chamber 2, flows through the risers 3 at the periphery of the disc stack 4, in which the liquid phase of lighter specific weight flows inwardly through the disc stack, reaching a paring chamber 6 through the passage 5, for example, and being carried out by a paring disc 7. The separated, specifically heavier solid matter is spun radially to the periphery of the drum and collects in the cooled solids chamber 8 where the coolable conical one piece insert 9, consisting of the lower portion 9*a* and the upper portion 9*b* is sealed off against the drum bottom 10 by the seals 11 and 12 and against the drum cover 14 by the seals 15 and 16. At the periphery of the insert there are disposed a plurality of apertures 17 which are in communication with congruent apertures 18 in the drum periphery 13 and can be opened (right side of cross section) or closed (left side of cross section) by an axially displaceable piston slide valve 19 of the kind described in French Pat. No. 77,363, which is operated by a control fluid.

For the cooling of the spin drum, and especially the cooling of the solids chamber 8, the coolant is brought in through a line 20 and flows from the catching trough 21 through passage 22 to passage 23 behind the lower insert portion 9*a*, is carried through an outwardly leading, helically disposed passage 24 to the outer periphery of the lower insert portion 9*a*, and flows through connecting passage 25 into the upper insert portion 9*b*, where it is carried through a passage 26 leading helically inwardly, through the return passage 27, and through a nozzle 28, which is sealed by gasket 29 within the drum bottom, into the opening chamber 30, the passages 25 and 27 being dispoed within rib 31 which joins together the lower part 9*a* and the upper part 9*b* of the insert. From the opening chamber 30, the coolant flows through bores 32 in the piston slide valve 18 into the frame chamber, and strikes against the cooling jacket 33, so that evaporation of the coolant is prevented and the coolant can be recirculated.

The removed solids are likewise thrown against a coolable insert 34 surrounding the drum.

In FIG. 2, the cooled solids collected in solids chamber 8 are continuously discharged through nozzles 35 which are disposed at the outer periphery of the drum 36, the nozzles being sealed to the apertures 17 of the insert 9 by one or more seals 37. Otherwise, the drum of FIG. 2 is like that of FIG. 1.

The insert disposed in the solids chamber is suitable not only for the use of coolants, but also for the heating of the solids chamber, for example, by the circulation of hot water in the insert.

In the embodiments illustrated, there is one rib 31. If desired, for balance, a second rib without passageways such as 25, 27, can be installed, opposite rib 31. Also, whereas in the embodiments shown there is one helical passageway 24 in lower insert portion 9*a* and one helical passageway 26 in upper insert portion 9*b*, there can be two or more helical passageways in each of the upper and lower insert portions, while there are a like number of passageways 23 communicating with passageway 22, and a like number of ribs 31 having passageways 25 and 27 for introducing and withdrawing the heat exchange fluid to the helical passageways in the lower insert portion 9*a*.

SUMMARY

Thus, the invention provides a centrifuge comprising a rotatable drum having an outer casing, a solids chamber within the outer casing, and a conical insert including an upper and a lower portion mounted in the drum and lining the wall of the outer casing within the drum. Means define a helical passageway for each the upper and lower portions of the insert, which passageways are for passage of heat exchange fluid between the insert and the wall of the outer casing within the drum, for indirect heat exchange with solids disposed in the solids chamber. The conical insert and the outer casing have aligned solids removal apertures at speed intervals about the peripheries thereof. According to the invention, a rib joins together the upper and lower insert portions, and there is a passageway in the rib, communicating the helical passageways in the upper and lower insert portions for transfer of the heat exchange fluid from one to the other of the upper and lower insert portions. Means are provided for introducing and withdrawing the heat exchange fluid into and from the helical passageways. The rib can provided wth a second passageway to serve for withdrawal of the heat exchange fluid from the insert.

What is claimed is:

1. Centrifuge comprising a rotatable drum having an outer casing, a solids chamber within the outer casing, a conical insert comprising an upper portion and a lower portion mounted in the drum and lining the wall of the outer casing within the drum, means defining a helical passageway for each the upper and lower portions of the insert, said passageways being for passage of heat exchange fluid between the insert and the wall of the outer casing within the drum, for indirect heat exchange with solids disposed in the solids chamber, the conical insert and the outer casing having aligned solids removal apertures at spaced intervals about the peripheries thereof, a rib joining together the upper and lower insert portions, and a passageway in the rib, communicating the said helical passageways in the upper and lower insert portions for transfer of the heat exchange fluid from one to the other of the upper and lower insert portions, and means for introducing and withdrawing the heat exchange fluid into and from the helical passageways.

2. Centrifuge of claim 1, and a second passageway in the rib, said second passageway being for the withdrawal of the heat exchange fluid.

3. Centrifuge of claim 1, and an axially movable piston slide valve mounted on the drum for opening and closing of the solids removal apertures.

4. Centrifuge of claim 2, and an axially movable piston slide valve mounted on the drum for opening and closing of the solids removal apertures.

5. Centrifuge of claim 1, and discharge nozzles mounted in the solids removal apertures for continuous discharge of solids.

6. Centrifuge of claim 2, and discharge nozzles mounted in the solids removal apertures for continuous discharge of solids.

* * * * *

UNITED STATES PATENT OFFICE

CERTIFICATE OF CORRECTION

PATENT NO. : 4,113,172

DATED : September 12, 1978

INVENTOR(S) : Gunthard Pautsch and Werner Kohlstette

It is certified that error appears in the above-identified patent and that said Letters Patent are hereby corrected as shown below:

Column 2, line 33, change "77,363" to -- 777,363 --.

Column 2, line 49, change "18" to -- 19 --.

Column 3, line 24, change "speed" to -- spaced --.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*